US008084078B2

(12) United States Patent
Burrell

(10) Patent No.: US 8,084,078 B2
(45) Date of Patent: Dec. 27, 2011

(54) MULTI-SPECTRAL IMAGING WITH DIFFERENTIAL VISUALIZABILITY IN DISCRETE VISUALIZATION DOMAINS

(76) Inventor: Jeff Burrell, Martinsville, VA (US)

( * ) Notice: Subject to any disclaimer, the term of this patent is extended or adjusted under 35 U.S.C. 154(b) by 360 days.

(21) Appl. No.: 11/736,483

(22) Filed: Apr. 17, 2007

(65) Prior Publication Data

US 2009/0017267 A1 Jan. 15, 2009

(51) Int. Cl.
*B05D 5/00* (2006.01)

(52) U.S. Cl. ..... 427/8; 427/256; 427/288; 2/900; 428/919

(58) Field of Classification Search ..... 427/8, 256, 427/288; 428/919; 2/900
See application file for complete search history.

(56) References Cited

U.S. PATENT DOCUMENTS 4,105,665 A * 8/1978 Harnisch ..... 546/66
4,868,019 A * 9/1989 Knickerbocker ..... 428/17
5,281,451 A * 1/1994 Reynolds ..... 428/17
5,409,760 A * 4/1995 Neitz et al. ..... 428/195.1
5,541,735 A * 7/1996 Rengle ..... 356/402
5,727,253 A * 3/1998 Wilkinson ..... 2/69
5,798,304 A 8/1998 Clarkson
6,127,022 A * 10/2000 Pretorius ..... 428/195.1
2005/0195363 A1 * 9/2005 Sato ..... 351/242

* cited by examiner

*Primary Examiner* — Frederick Parker
*Assistant Examiner* — Alex Rolland
(74) *Attorney, Agent, or Firm* — Steven J. Hultquist; Richard T. Mattthews; Hultquist IP

(57) ABSTRACT

A multi-spectral imaging process, comprising: selecting colors for presentation in a target visualization regime; determining correspondence of said colors in the target visualization regime to colors in a source visualization regime; and fabricating a product in the source visualization regime having a coloration that produces a predetermined visual presentation of the object in the target visualization regime. Such process can be utilized to fabricate articles having coloration including a blaze orange coloration in a source visualization regime involving a human observer and a camouflage pattern in a target visualization regime involving an animal observer.

29 Claims, 2 Drawing Sheets

MULTI-SPECTRAL IMAGING WITH DIFFERENTIAL VISUALIZABILITY IN DISCRETE VISUALIZATION DOMAINS

FIELD OF THE INVENTION

The present invention relates to visualization and camouflage phenomena, involving multi-spectral imaging with differential visualizability in discrete visualization domains.

DESCRIPTION OF THE RELATED ART

Many applications exist for using materials and articles that are more prominently seen in a first visual environment than in a second visual environment, as well as the reverse circumstance of using materials of articles that are less visible or even camouflaged in specific circumstances relative to other environments in which they may be present. Examples include materials that fluoresce under ultraviolet radiation, down-converting or up-converting phosphors for use in lighting displays and systems, and dyes that facilitate detection under infrared light.

There is also an increasing realization that vision systems of animals are very different in various animal species. This is a consequence of widely varied visual physiology among such species, with the result that colors or regions of the electromagnetic spectrum that are visually accessible to one species may be perceived quite differently or even not at all, by other species. By way of example, many insects see in the ultraviolet spectrum, while humans can perceive light at wavelengths in a range of from about 400 to 700 nanometers. Many species of non-primate mammals, e.g., deer, pigs, cows, other ungulates, rabbits, squirrels, dogs and cats, have dichromatic vision as a result of visual systems possessing two types of cone elements, while primates and humans possess three types of such elements and therefore are trichromatic. Some fish and turtles are tetrachromatic. As a general consideration, color is not an intrinsic property of an object, but rather is a perception determined by the nervous system of an organism, resulting from differences in output of receptor types.

Efforts have been made to understand the implications of these differences, particularly in the field of camouflage, in which the goal is to make an object blend into its surroundings so that it is not perceptually distinguished from such environs by an observer. In instances in which camouflage is sought to be effective to hide a person or an object from an observer of a different species, this goal is rendered more difficult when a different visual system is possessed by a non-human observer, as in camouflage for hunting applications, or when a different visual system is possessed by a machine or robotic observer, as in military and intelligence-gathering or other surveillance activities.

There is accordingly an ongoing effort to develop and commercialize camouflage systems, as well as technologies for differential visualization in different visual regimes.

U.S. Pat. No. 5,409,760 to Neitz et al. describes a camouflage material including first segments containing a first coloring agent, which causes photopic light emissions from said first segments to occur predominantly within a first band of wavelengths, and second segments containing a second coloring agent, which causes photopic light emissions from said second segments to occur predominantly within a second band of wavelengths, such that a normal human observer cannot spatially resolve the first and second segments from a distance of 100 meters in a Two-Alternative Forced Choice Test, and wherein combined photopic light emissions from the first and second segments induce the same perception of color in a deer as a monochromatic light at 480+/−25 nm.

U.S. Pat. No. 4,868,019 to Knickerbocker describes a camouflage sheet that optionally appears to be a single color to a color blind animal but actually comprises different colors or different hues of the same color when viewed by a human. Knickerbocker further discloses that the colors could be selected to maximize the perceptibility of the camouflage to hunters.

U.S. Pat. No. 6,127,022 to Pretorius describes a camouflage surface for concealment from, and deception of, an herbivorous animal. The surface includes a camouflage pattern constituted by a plurality of occurrences of at least two different types of regions that reflect electromagnetic radiation at wavelengths in the near-infra-red range of the electromagnetic spectrum. The different types of regions have, in a near-infra-red range, spectral reflectance curves having reflectance maxima at wavelengths of at least 680 nm, with each spectral reflectance curve which the surface has in the visible light range of the electromagnetic spectrum being without a reflectance maximum in the wavelength range between 480 and 680 nm and each spectral reflectance curve which the surface has in the visible light range having a reflectance maximum at a wavelength of at most 480 nm. This patent discloses that such camouflage pattern will not be apparent to the human eye, but it is apparent to the eye of a herbivore such as a buck, deer or antelope, whose eyes will evolve to see and perceive colors in the near infrared range of the electromagnetic spectrum.

U.S. Pat. No. 5,798,304 to Clarkson describes a fabric that presents a non-camouflage pattern under visible light and a camouflage pattern under infrared radiation, with the reflectivity of the camouflage pattern being selected to match that of the selected surroundings.

U.S. Pat. No. 5,541,735 to Rengle describes a method of selecting colors and patterns relating to a nonhuman's ability to optically distinguish the colors and patterns from a background environment. The method involves viewing and light intensity measurement of items against a representative background environment, using a light filter that passes light waves simulating both the spectral sensitivity of a nonhuman's eye rod photoreceptors and the spectral sensitivity of a nonhuman's eye cone photoreceptors during a specified light condition.

The art continues to seek improvements in camouflage and differential visualization technology for detection and obscuration applications.

SUMMARY OF THE INVENTION

The present invention relates to visualization and camouflage phenomena, involving multi-spectral imaging with differential visualizability in discrete visualization domains.

In one aspect, the invention relates to a multi-spectral imaging process, comprising: selecting colors for presentation in a target visualization regime;

determining correspondence of said colors in the target visualization regime to colors in a source visualization regime; and fabricating a product in the source visualization regime having a coloration that produces a predetermined visual presentation of the object in the target visualization regime.

In another aspect, the invention relates to a process comprising transcription of (1) a visual appearance desired to be perceived by a target observer in a target visualization regime, involving specific coloration and color contrast, by application of (2) a spectral correlation of color that is observable by the target observer in the target visualization regime to color that is observable by a source observer in a source visualization regime, to yield (3) the desired visual appearance perceivable by the target observer in the target visualization regime.

In a further aspect, the invention relates to a system for fabricating an article having different appearance in each of source and target visualization regimes, comprising a correlation table including a first set of color values for the source visualization regime, and a corresponding second set of color values for the target visualization regime, wherein the source visualization regime comprises a human observer and the target visualization regime comprises a non-human animal or machine visualization apparatus.

A further aspect of the invention relates to a article having coloration comprising a blaze orange coloration in a source visualization regime comprising a human observer and a camouflage pattern in a target visualization regime comprising an animal observer.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
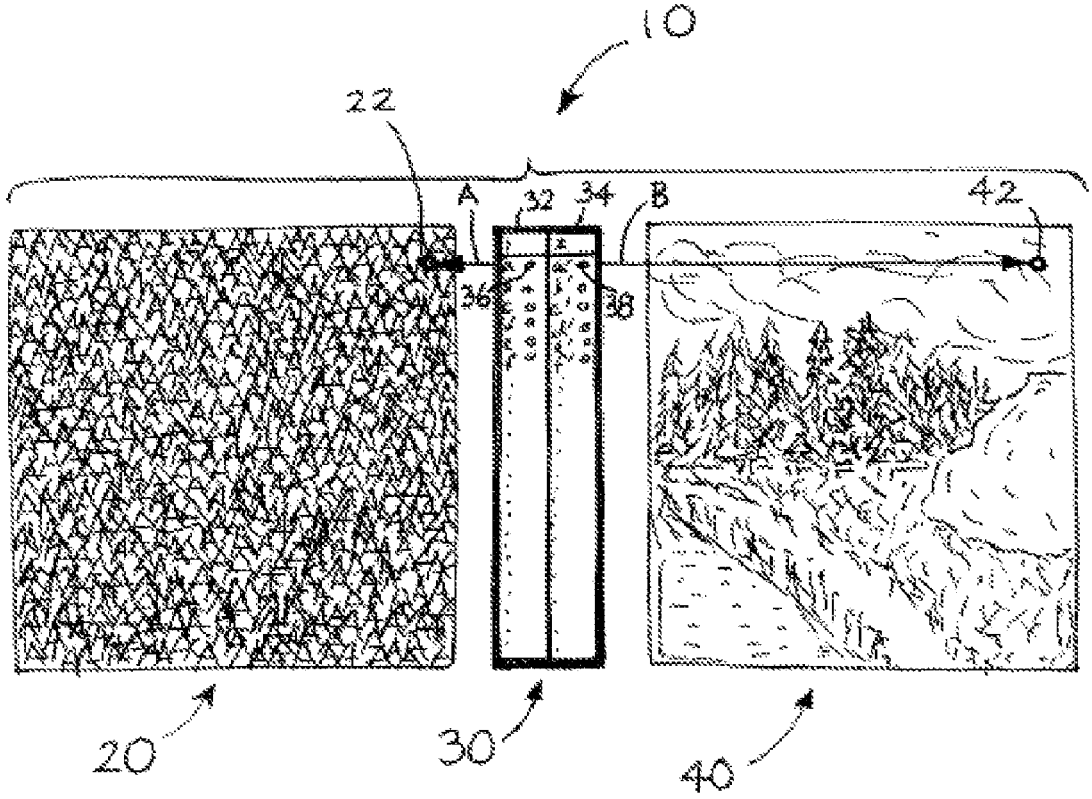
FIG. 1 is a schematic representation of a reverse transcription system including a target visualization regime panel presenting a depiction as it would be perceived by an intended observer in such target visualization regime.

The present invention relates to visualization and camouflage phenomena, involving multi-spectral imaging with differential visualizability in discrete visualization domains. The term "multi-spectral" used in such context refers to the character of an object, as having different coloration to observers with different photoreceptor systems, e.g., different visualization chromatic modes (for example, dichromatic versus trichromatic, trichromatic versus tetrachromatic, etc.) of different animal species, or different spectral visualization regimes of the electromagnetic spectrum. The term "visualization regime" means a specified wavelength or wavelength range of the electromagnetic spectrum in which an object is perceivable by an observer (e.g., animal or machine), with different visualization regimes in accordance with the present invention involving different types of respective observers.

The present invention in one aspect thereof involves reverse transcription of (1) a visual appearance desired to be perceived by a target observer in a target visualization regime, involving specific coloration and color contrast, by application of (2) a spectral correlation of color that is observable by the target observer in the target visualization regime to color that is observable by a source observer in a source visualization regime, to yield (3) the desired visual appearance perceivable by the target observer in the target visualization regime. By such manipulation, the desired visual appearance and spectral correlation can be utilized to fabricate an object having a first visual appearance to a first observer in the source visualization regime, and a second visual appearance to a second observer in the target visualization regime.

For example, the target visualization regime may be a visualization regime of a deer and the desired visual appearance may be a camouflage appearance comprising visual elements simulative of trees, foliage, pasture, fields or other natural surroundings. The source visualization regime for such purpose may be a human visualization regime with a human-observeable appearance that is different from the deer-observable appearance in the target visualization regime. The same object therefore appears visually different in the respective source and target visualization regimes to the observers defining such regimes. In general, the visual appearance in the source visualization regime or target visualization regime may be simulative of objects, forms, locations, landscapes, seascapes, sky, buildings, structural installations, or other natural or artificial environments or indicia.

In the implementation of the invention, the visual appearance actually perceived by a first observer in a source visualization regime, and corresponding to the desired appearance in the target visualization regime, can be used as a "pattern" or "master" that can be copied or otherwise utilized to produce a product, e.g., material, object or tangible element, having differential visualization capability in the respective source and target visualization regimes.

The cross-correlation between color perceived by the source observer in the source visualization regime and the different color perceived by the target observer in the target visualization regime can be established in any suitable manner. For example, a color key can be prepared based on the photoreceptor structures in the respective first and second observers, e.g., involving determinations based on the rod and cone receptors in the visualization systems of human and non-human mammals, or by stimulus/response empirical methods determinative of the spectral perception of the respective observers, by nervous system measurements associated with animal visual functions, or in any other appropriate manner that yields a correlate color in the target visualization regime for a specific color in the source visualization regime.

As a specific example, the color green in the first visualization regime may correlate to the color orange in the second visualization regime, the color yellow in the first visualization regime may correlate to the color brown in the second visualization regime, etc.

By determination of the color correlates in the respective visualization regimes, it is possible to color objects for visual presentation to create a predetermined appearance in a different visualization regime than the one in which the object is fabricated. Thus, this color mapping or cross-correlation relationship permits dyeing, printing, painting, silkscreening, mosaic fabrication, color composite element assembly, etc., to achieve the desired appearance of the object in the target visualization regime.

In this manner, apparel or accessory items can be mass-produced, to provide a specific visual appearance in the target visualization regime that is distinguishing, or alternatively obscurant, of the wearer. This may be achieved by shifting the color spectrum of a color that is seen in a specific shade, or is not seen at all, by a human observer, to a color that can be seen by a non-human observer.

For example, the coloration of a visualization object can be varied so that the object is visualizable in both human observer and non-human observer regimes, with the coloration variation being such as to preserve a same or nearly same color in the human observer source regime while at the same time being visualizable in the non-human observer target regime.

As a specific example, the color red may be color-shifted so as to be readily perceivable by a hooved animal such as a deer, while still appearing to be reddish in color to a human observer. This can be accomplished by patterning, and/or color addition and/or color subtraction techniques utilizing individual color points in an array of such points producing the desired visual appearance.

As a further example, a visualization object may be colored to provide a camouflage appearance when viewed by a deer while being perceivable in the human visualization regime as a blaze orange coloration appropriate to meet regulatory requirements for hunters.

It will be appreciated that the foregoing approach may be applied to a wide variety of tangible objects, including hunting and fishing gear, land vehicles, aircraft, marine craft, clothing, personal accessories, living structures, camping gear, military equipment, sidewalk and roadway materials, furniture, building materials, appliances, etc.

FIG. 1 is a schematic representation of a transcription system 10 including a target visualization regime presentation panel 40 presenting a depiction as it would be perceived by an intended observer in such target visualization regime. The system includes in this schematic representation a source visualization regime presentation panel 20 shown as it would be perceived by a source regime observer having a different visualization system from the target regime observer.

For example, the source regime presentation panel 20 may be perceived by a human observer as having the appearance illustratively shown in FIG. 1, and the same presentation panel in the target visualization regime may be perceived by a non-human animal or by a machine observer as having the appearance illustratively shown in the target regime presentation panel 40.

The appearance of the panel could alternatively be of a single color or color shade as perceived by a human observer, and a variety of colors or color shadings as perceived by a non-human animal or a machine observer in the target visualization regime.

In order for the source regime presentation panel 20 to have the appearance in the target visualization regime as shown in FIG. 1, a correlation between colors in the source visualization regime and colors in the target visualization regime must be established. This is provided in the FIG. 1 system by the correlation table 30, which provides a first set 32 of color values 36 for the source visualization regime, and a corresponding second set 34 of color values 38 for the target visualization regime.

The correlation table 30 may be of any suitable form, as effective to provide a correspondence between respective colors in the source and target visualization regimes, so that a source regime color is determinable for a specific target regime color. The correlation table 30 can for example be a look-up table embodied in software or firmware that programmatically establishes the color pairs that correspond to one another in the respective source and target visualization regimes.

With such correlation between source and target regime colors, color mapping may be carried out, e.g., using a central processing unit (CPU) including a microprocessor, programmable logic controller (PLC), general-purpose programmable computer, or other computational apparatus.

Alternatively, the correlation table 30 may be utilized by an individual artist to translate a desired target regime depiction, such as a camouflage pattern, camouflage scene, landscape, predator depiction, etc., into a source depiction having the desired appearance in the source visualization regime. The artist then can use a palette of source visualization regime colors to create the desired target regime depiction, so that it is viewed as the desired depiction in the target regime.

Regardless of the specific translational process or means employed, the correlation table or other correlation medium, once established, can be readily utilized in the source regime to create the desired depiction when viewed in the target regime by the target observer.

In the system shown in FIG. 1, the correlation table provides a listing of color values for each of the source and target regimes that correspond to one another. Thus, the color value 36 represents the specific color that is present in pixel 22 of the source regime presentation panel 20, as indicated by arrow A, and this same color value 36 in the source regime corresponds to color value 38 in the target visualization regime, as present in pixel 42 of the target regime presentation panel 40 and indicated by arrow B.

Figure 2:
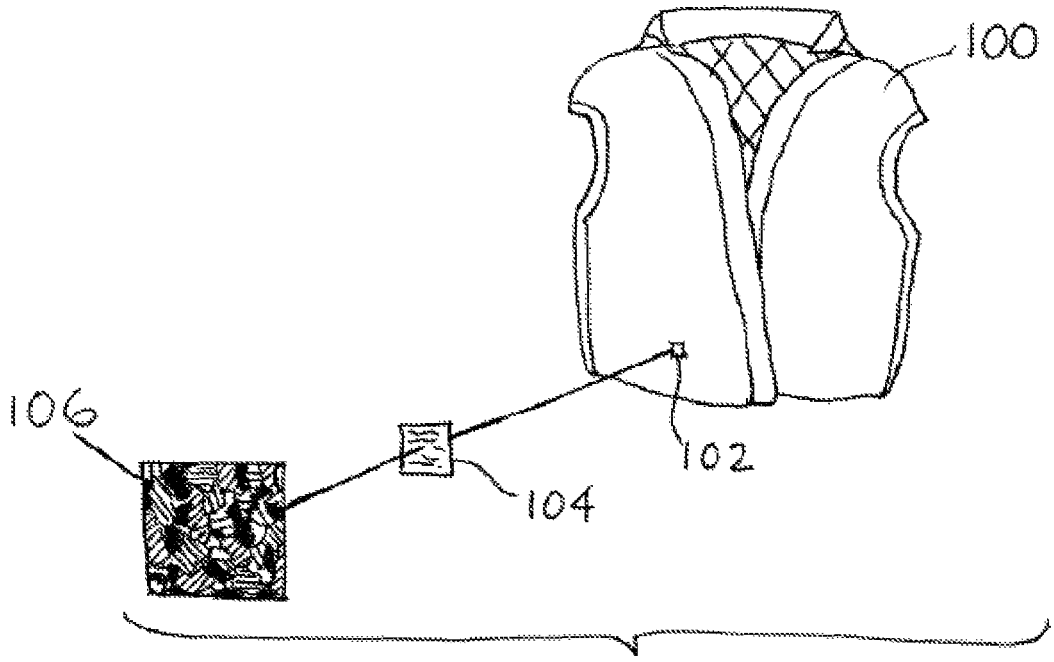
FIG. 2 is a schematic illustration of a vest that is manufactured to present a blaze orange coloration to a human observer and a camouflage pattern to a hooved-animal, e.g., a deer.

FIG. 2 is a schematic illustration of an apparel item 100, namely, an insulated vest, that is manufactured to present a blaze orange coloration to a human observer. Such coloration is compliant with hunting regulations, to afford visibility to other hunters of a person wearing such apparel item.

The vest 100 is shown with a unit area portion 102 viewed through a translational filter 104 to provide a visualization segment 106 showing the unit area portion of the vessel as it would be perceived by a deer or other animal. Specifically, such view of the visualization segment 106 has a dappled or mottled appearance that readily blends with an outdoor natural environment to assist in the concealment of the wearer from the deer who may be in physical proximity to such wearer. The translational filter 104 is formed of a material that is selectively transmissive of light in the spectral regime corresponding to the deer's visualization system of rod and cone photoreceptor elements, so that the visualization segment 106 as viewed through the filter by a human observer corresponds to what would be seen by the deer in a natural environment.

As a result, it is possible to color a hunting vest so that it simultaneously complies with applicable blaze orange coloration requirements, while at the same time such vest presents a camouflage appearance to deer.

The translational filter is usefully employed as a consumer accessory that may for example be packaged with the apparel item or other object differentially colored in the respective source and target regimes, so that the prospective purchaser can see the visual appearance that is manifested to a deer in the target visualization regime.

The invention therefore contemplates packaging of a product article with an appropriate filter article that can be used to show the visual appearance manifested in the target visualization regime by the product. The translational filter can also be employed as a spot-check quality assurance tool, to verify manufacturing of a product having a desired visual appearance in the target visualization regime.

Although the preceding discussion has been directed to a hunting vest as an illustrative article of apparel, it will be appreciated that the generalized approach described above can be applied to camouflage clothing and other articles, materials and other products of widely varying character.

It will also be appreciated that the generalized approach described above can be utilized in a variety of implementations for imparting coloration or visual signature that is different in different visualization regimes, as perceivable (in the various regimes) by humans or other animals, including mammalian as well as non-mammalian animals, e.g., fish, insects, birds, amphibians, reptiles, etc., with or without machine- or instrument-assisted vision, or by machines alone.

The correspondence color mapping method of the invention therefore is amenable to use in a wide variety of end-use applications, employing any of various suitable coloration techniques, such as dying, printing, silkscreening, painting, coating, etc., optionally with multiple ones of such techniques being employed, as may be desired to effect a desired color scheme and visual presentation.

The advantages and features of the invention are further illustrated with reference to the following examples, which are not to be construed as in any way limiting the scope of the invention but rather as illustrative of possible embodiments in specific applications of the invention.

Example 1

In development of the color correlation for a camouflage material, a filter is employed that permits a human to visualize color tonality and intensity that would be viewed by a target organism, such as a deer, elk, antelope, caribou or other hoofed animal, in the target visualization regime. The filter is formed of a transparent film material that enables viewing of the color that is seen by the hoofed animal. The filter is utilized to construct a camouflage pattern that is obscurative in the hoofed animal's visualization regime, taking advantage of the fact that while humans have ability to see colors including yellow, blue, red, and green in the visual light spectrum, the deer sees only green and blue colors.

For such purpose, the filter is constructed to remove the red photorecepter components from the visual image to be presented, to thereby simulate what the deer sees and to assist in determining proper shades for the camouflage pattern. In determining the colors used in the camouflage pattern, colors are used that humans see as similar in shade, but which when viewed by a human observer with the filter are very different in color.

Once the camouflage pattern is determined, the camouflage pattern is printed. The printing can be carried out on any suitable fabric, stock or web material. For example, the material used as the substrate for the camouflage printing can include, without limitation, polyester, nylon, cotton, etc. Printing can be carried out with a digital or roller screen printer, with the pattern being developed and screens being fabricated to apply each individual color to the substrate for the camouflage pattern.

In one embodiment, the substrate is dyed with a ground shade and then printed. Alternatively, the ground shade may be printed as well, leaving the reverse side white or undyed. Both sides of the substrate can be printed or dyed or alternatively, only one side may be subjected to colorizing treatment. Printing can be carried out by making up each individual color in a "clear mix" that includes an anti-migrant, wetter, and a binder.

This clear mix is advantageously made in advance, in a large volume. A tank is prepared for each screen, combining the clear and dye components to match the particular shade being used for a given screen. By way of example, one screen may be employed to apply a brown or orange that constitute the leaves in a pattern, while another screen may be used to apply color constituting the limbs or grass in the pattern, and so on, with each color assisting in building the desired pattern.

A typical formulation is 85 parts clear, 5 parts yellow and 10 parts orange, to make a total of 100 parts in the formulation. After the colors are rolled onto the cloth with the screens, the cloth is dried at ambient or near-ambient temperature, e.g., at temperature in a range of from about 40° F. to 120° F., when only pigments are present in the formulation. When the pattern is formed using disperse dyes, the cloth is dried at ambient temperature, then translated through an oven at 400-420° F., for brief elevated temperature exposure of 30-60 seconds duration.

In either case, the resulting cloth is washed in wash boxes at 160° F. and then dried.

The cloth produced by the foregoing steps, bearing the applied camouflage pattern, next is rolled up onto an A-frame for transport to the finishing process where a softener is applied and the cloth then is dried. The finished cloth thereupon is packaged and shipped to a fabricator to manufacture products such as hats, caps, vests, or other apparel or accessory items bearing the camouflage pattern. Such a camouflage pattern may be camouflaging in character only in the target visualization regime, e.g., to a deer.

Quality control of the manufactured product is accommodated by using a filter that is constructed to enable visualization of the product article in the target visualization regime, as it would be perceived by the hoofed animal in such regime. This quality assurance visualization with the filter permits human visual confirmation that the target regime appearance of the product conforms to the desired standard.

Example 2

In another embodiment, individual lots of yarns could be individually dyed with appropriate dyes for the differentially visualizable product article, following which respective yarns of different colors or patterns can be woven or otherwise assembled to provide the desired differential visualizability in the product article.

By way of specific example, yarn in packages are placed in a vessel and dyed in a bath under pressure at temperature in a range of from 100° F. to 285° F. The number of packages of yarns correspond to the number of colors in the desired pattern of the product article. After dyeing, the yarn is washed and dried and put through a slasher to add lubricants, starch, and other chemicals, as necessary or desirable to accommodate the weaving process.

The yarn then is woven into cloth, following which the cloth is washed and a softener or finish optionally is added. The cloth next is rolled and packaged, and sent to the fabricator to produce the product article.

While the invention has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

What is claimed is:

1. A multi-spectral imaging process, comprising:

selecting colors of a specified wavelength or within a wavelength range to predetermine a visual presentation comprising specific coloration and color contrast in a target visualization regime;

performing reverse transcription using a spectral correlation to determine correspondence of each of said colors in the target visualization regime to a color in a source visualization regime, wherein reverse transcription of the predetermined visual presentation in the target visualization regime results in a correlated visual presentation in the source visualization regime; and fabricating an object with the correlated visual presentation of the source visualization regime that produces the predetermined visual presentation of the object in the target visualization regime;

wherein the process comprises at least one of the following characteristics:

(a) the source visualization regime comprises visual perception of a human or a visualization machine-enhanced human, and the target visualization regime comprises visual perception of a non-human animal or of a machine;

(b) said visual presentation of the object in one of the source and target visualization regimes comprises a camouflage presentation; and (c) said color selection is such that the visual presentation of the object in one of the source and target visualization regimes comprises a presentation that is more readily visually discriminated than the object lacking such coloration.

2. The process of claim 1, wherein the source visualization regime comprises visual perception of a human or a visualization machine-enhanced human, and the target visualization regime comprises visual perception of a non-human animal or of a machine.

3. The process of claim 1, wherein said visual presentation of the object in one of the source and target visualization regimes comprises a camouflage presentation.

4. The process of claim 1, wherein said color selection is such that the visual presentation of the object in one of the source and target visualization regimes comprises a presentation that is more readily visually discriminated than the object lacking such coloration.

5. A process comprising reverse transcription of a visual appearance desired to be perceived by a target observer in a target visualization regime, the appearance comprising specific coloration and color contrast of a specified wavelength or within a wavelength range, by application of a spectral correlation of color observable by the target observer in the target visualization regime to color that is observable by a source observer in a source visualization regime, to yield a source object having a first visual appearance perceivable by the source observer in the source visualization regime and a second, desired visual appearance perceivable by the target observer in the target visualization regime; wherein the process comprises at least one of the following characteristics:

(a) wherein the target visualization regime comprises a visualization regime of a deer and the desired visual appearance comprises a camouflage appearance comprising visual elements simulative of natural surroundings; and (b) a master pattern comprising the source object, and mass-producing a product with such master pattern.

6. The process of claim 5, wherein the target visualization regime comprises a visualization regime of a deer and the desired visual appearance comprises a camouflage appearance comprising visual elements simulative of natural surroundings.

7. The process of claim 6, wherein the source visualization regime comprises a visualization regime of a human, with a visual appearance in the source visualization regime that is different from the visual appearance in the target visualization regime.

8. The process of claim 5, further comprising a master pattern comprising the source object, and mass-producing a product with such master pattern.

9. The process of claim 8, further comprising use of a filter permitting a source observer to view in said product as it would be visually perceived by a target observer, to thereby maintain quality assurance of said product.

10. The process of claim 8, wherein mass-producing said product comprises applying color to said product by a process selected from the group consisting of dyeing, printing, painting, silkscreening, mosaic fabrication, color composite element assembly, and combinations thereof.

11. The process of claim 10, wherein said product is formed of a material comprising at least one of polyester, nylon and cotton.

12. The process of claim 10, wherein said applying color comprises printing with a digital or roller screen printer.

13. The process of claim 12, wherein said applying color comprises use of a printing composition comprising a color component in a clear mix comprising anti-migrant, wetter and binder.

14. The process of claim 13, wherein said printing composition comprises 85 parts clear, 5 parts yellow and 10 parts orange, in 100 parts of the composition.

15. The process of claim 13, wherein successive colors are applied by corresponding printing compositions, followed by drying at temperature in a range of from about 40° F. to about 120° F.

16. The process of claim 13, wherein successive colors are applied by corresponding printing compositions, followed by drying at ambient temperature and elevated temperature exposure to temperature of 400° F. to 420° F.

17. The process of claim 16, wherein said elevated temperature exposure as a duration of from 60 to 90 seconds.

18. The process of claim 13, further comprising quality assurance including use of a filter adapted to enable visualization of the product coloration as presented in the target visualization regime.

19. The process of claim 18, wherein said product comprises an apparel item.

20. The process of claim 8, wherein said product comprises an apparel or accessory item.

21. The process of claim 20, wherein said apparel or accessory item has a blaze orange coloration in the source visualization regime, and has a camouflage appearance in the target visualization regime.

22. The process of claim 8, wherein said product comprises an article, structure or material selected from the group consisting of: hunting and fishing gear, land vehicles, aircraft, marine craft, clothing, personal accessories, living structures, camping gear, military equipment, sidewalk and roadway materials, furniture, building materials, and appliances.

23. The process of claim 5, wherein the source observer and target observer differ from one another in visual systems.

24. The process of claim 23, wherein the source observer and target observer differ from one another in numbers of cone components of their respective visual systems.

25. The process of claim 5, wherein the spectral correlation of color comprises a color key.

26. The process of claim 25, wherein said color key is embodied in firmware or software.

27. The process of claim 25, wherein said color key is embodied in a color key card.

28. The process of claim 5, wherein said object comprises an assembly of parts, including parts each having a different color and/or pattern.

29. The process of claim 28, wherein the parts comprise woven parts.

* * * * *